US008356453B2

(12) United States Patent
Rice

(10) Patent No.: US 8,356,453 B2
(45) Date of Patent: Jan. 22, 2013

(54) BRACKET AND BRIDGING MEMBER FOR METAL STUD WALL

(75) Inventor: John Rice, Aurora (CA)

(73) Assignee: Bailey Metal Products Limited, Concord, ON (CA)

( * ) Notice: Subject to any disclaimer, the term of this patent is extended or adjusted under 35 U.S.C. 154(b) by 0 days.

(21) Appl. No.: 13/210,050

(22) Filed: Aug. 15, 2011

(65) Prior Publication Data

US 2011/0296786 A1 Dec. 8, 2011

Related U.S. Application Data

(63) Continuation of application No. 11/352,335, filed on Feb. 13, 2006, now Pat. No. 8,011,160.

(30) Foreign Application Priority Data

Feb. 11, 2005 (CA) ..... 2496961

(51) Int. Cl.
*E04G 21/00* (2006.01)

(52) U.S. Cl. ..... 52/745.09; 52/317; 52/653.1; 52/667; 52/712; 248/247

(58) Field of Classification Search ..... 52/653.1, 52/702, 712, 489.1, 317, 656.1, 656.9, 699, 52/700, 666–668, 745.09, 763, 779; 248/247
See application file for complete search history.

(56) References Cited

U.S. PATENT DOCUMENTS 3,322,447 A * 5/1967 Biggs ..... 403/252
5,904,023 A * 5/1999 diGirolamo et al. ..... 52/712
6,701,689 B2 * 3/2004 diGirolamo ..... 52/667
6,739,562 B2 * 5/2004 Rice ..... 248/247

* cited by examiner

*Primary Examiner* — William Gilbert

(57) ABSTRACT

The present invention provides for a bracket for use in a metal stud wall having internal bridging members for tying the metal studs and bridging members together. The bracket is an L shaped bracket having a leg for overlying the bridging member joined to an upright for overlying the metal stud. The outside corners of the leg and upright of the L shaped bracket are truncated such that the diagonal dimension across the L-shaped bracket is less than the width of the channel of the metal stud so that the bracket may be inserted within the channel of the metal stud and rotated to the proper position for attaching to the bridging member and metal stud.

4 Claims, 5 Drawing Sheets

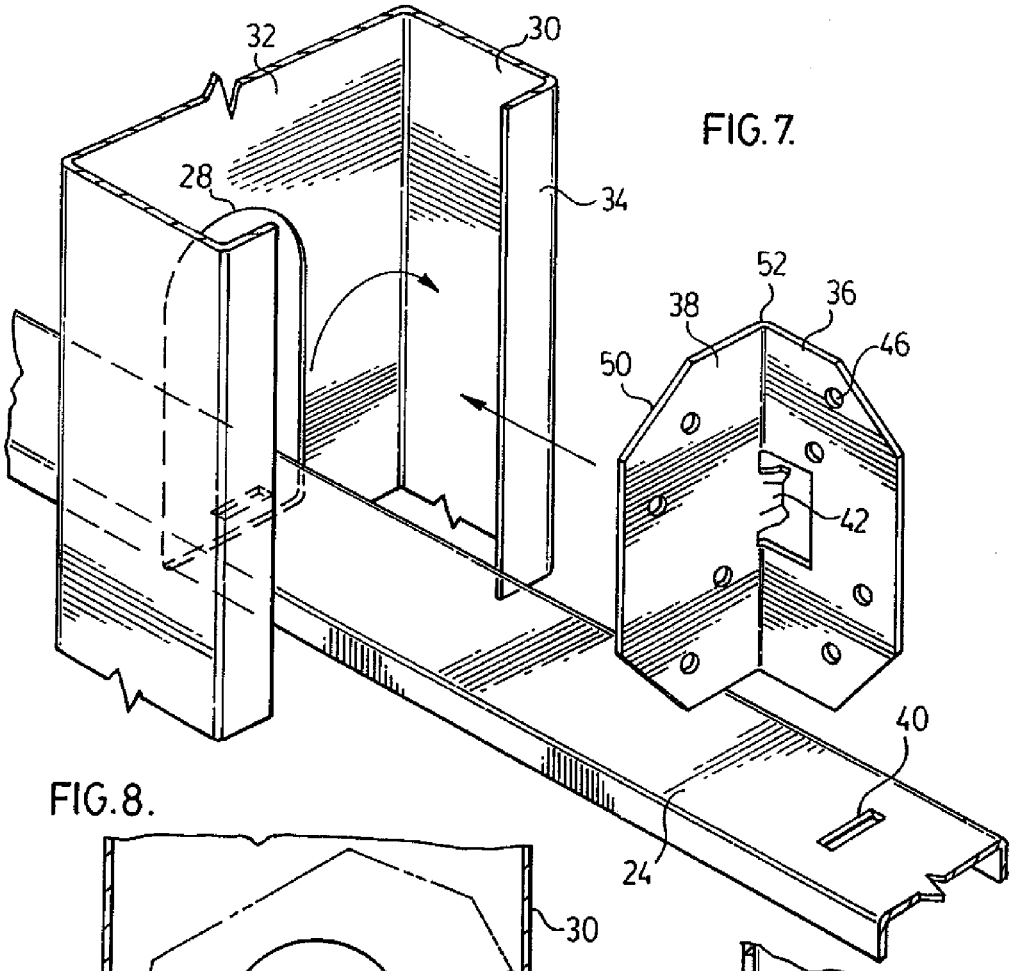
FIG. 7.
FIG. 8.
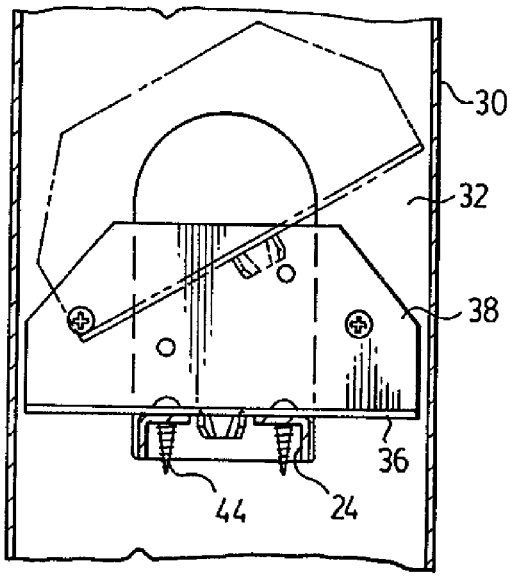
FIG. 9.
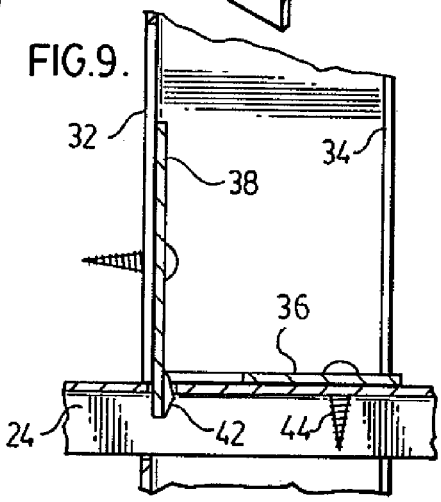

BRACKET AND BRIDGING MEMBER FOR METAL STUD WALL

CROSS REFERENCE TO RELATED APPLICATIONS

This application is a continuation of application Ser. No. 11/352,335, filed Feb. 13, 2006.

FIELD OF THE INVENTION

The present invention relates to a bracket for attaching bridging to the studs of a metal stud wall, in particular a bracket which is simple and quick to install on either side of the web of the metal stud. The present invention also relates to bridging members for metal stud walls having openings therein at regular spaced intervals to aid in spacing of studs in the stud wall.

BACKGROUND OF THE INVENTION

Metal studs for use in constructing partition walls are becoming more prevalent. The metal studs have a generally C shaped cross section and are utilized in a manner similar to wooden studs for constructing partition walls. The metal studs are typically arranged vertically and tied together at the top and bottom by U shaped channel members which act as top and bottom plates for the stud wall. Stud walls which are subjected to wind and or axial loads such as is found if the stud wall forms the exterior wall or is a load bearing wall, require lateral support to provide resistance to rotation and minor axis bending under wind and axial loads.

The lateral support for the metal stud. walls is generally provided by installing bridging members which tie the metal studs together at points intermediate the ends of the studs. These bridging members may be either metal strapping attached to the outside flanges of the studs or may be internal bridging members installed through openings provided in the web in the metal stud. In order to transfer the support provided by the internal bridging members to the metal studs, the bridging members are physically tied to the metal stud. In most installations, L shaped brackets are provided to transfer the support provided by the interior bridging members to the edges of the metal studs. These L shaped brackets are attached to the metal stud and the bridging member with the leg of the bracket being fastened to the interior bridging member and the upright of the L shaped bracket being attached to the metal stud. Where the bracket is installed on the outside of the web of the stud, it is a simple matter for the installer to lay the bracket in place and attach it to the bridging member and to the stud. If for some reason however, the bracket must be installed on the interior of the stud within the C channel, the bracket must be inserted into the interior of the stud at the top or bottom and slid to the proper position. As this must be accomplished before the stud is attached to the top track, it can increase the erection time necessary for the wall especially if the installer has to disconnect the stud from one of the tracks in order to install the bracket. There thus remains a need for a simple to install bracket for bridging members and metal studs which can be easily installed on either side of the web of the stud.

SUMMARY OF THE INVENTION

The present invention provides in one aspect for a bracket for use in a metal stud wall having internal bridging members for tying the metal studs and bridging members together. The bracket comprises an L shaped bracket having a leg for overlying the bridging member joined to an upright for overlying the metal stud. The outside corners of the leg and upright of the L shaped bracket are truncated so that the bracket may be inserted within the channel of a metal stud and rotated to the proper position for attaching to the bridging member and metal stud.

In an aspect of the invention, there is provided a bridging member for a metal stud partition wall, the bridging member being provided with openings at regular intervals along its length thereof to aid in spacing of the studs in the metal stud partition wall.

In another aspect of the invention, an L shaped the bracket is provided having a leg for overlaying the bridging member and an upright for overlaying the metal stud. The bracket has a downwardly extending tab at the junction of the leg and the upright sized to fit within the opening of the bridging member.

BRIEF DESCRIPTION OF THE DRAWINGS

Preferred embodiments of the present invention are illustrated in the attached drawings in which:

FIG. 7 is a perspective view illustrating the installation of the bracket of FIG. 2 within the channel of the metal stud;

FIG. 8 is a side elevation view of the bracket of FIG. 2 being installed within the channel of the metal stud; and FIG. 9 is a cross section view of the bracket of FIG. 2 installed in the orientation in accordance with FIG. 8.

DETAILED DESCRIPTION OF THE PREFERRED EMBODIMENTS

Figure 1:
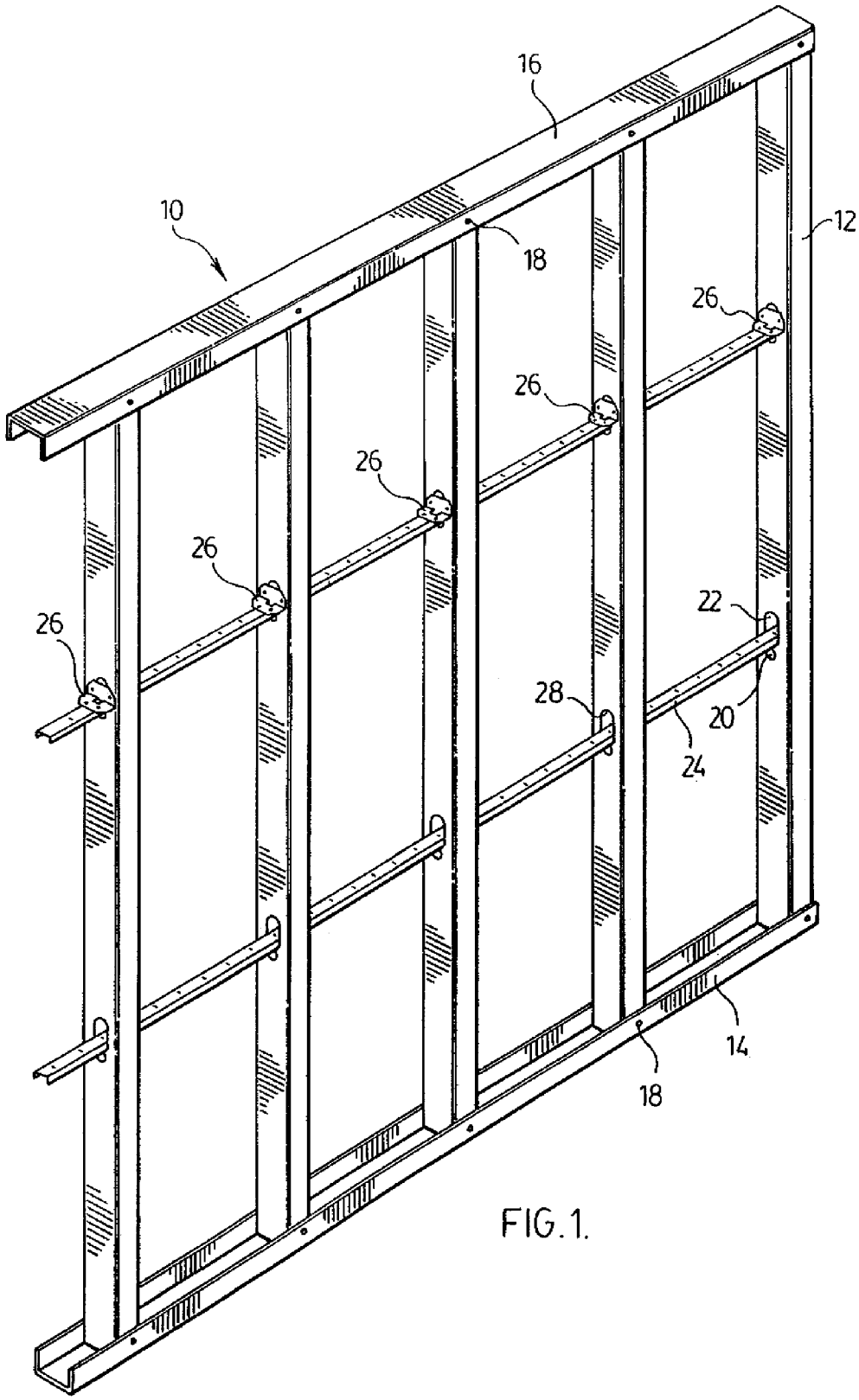
FIG. 1 is a perspective view of a typical metal stud wall.

FIG. 1 illustrates a typical metal stud wall. generally indicated by the number 10. Stud wall 10 is constructed of a series of parallel spaced apart metal studs 12 held in position by a bottom track 14 and a top track 16. Metal studs 12 are connected to The bottom track 14 and top track 16 by the use of suitable screws 18. Metal studs 12 are provided with first generally circular openings 20 which are used for running utility services such as electrical wiring or plumbing pipes there through. The metal studs 12 are also provided with second openings 22 which are used to hold suitable bridging members 24. Bridging members 24 are tied to the metal studs 12 by brackets 26 as will be described herein below. Typically, second openings 22 are provided at a regular Spaced interval along the length of the stud 12. The spacing between the openings 22 is generally on the order of between about 2 and 4 feet. Thus for an eight-foot metal stud 12 two such openings 22 are provided on each stud 12 equally spaced to provide a spacing of about two and one third feet between each of the openings 22. Similarly a 10 ft. stud 12 would generally be provided with two such openings 22 to provide a spacing of three and one-third feet between the openings 22.

Longer studs 12 such as 12 to 16 ft, studs would be provided with three or four such openings 22 to allow the proper spacing for the bridging numbers 24 to provide the support for the metal stud wall 10.

The shape of the openings 22 can vary depending upon the manufacturer of the metal studs 12. One common shape utilized is a rectangular opening with an arched Lop 28 such as is illustrated in the figures. Other shapes including rectangular openings with a peaked top and in some cases a peaked bottom are also known. Irrespective of the shaping of the opening 22, the common feature is that the opening 22 should allow the bridging member 24 to pass through the opening 22 and be placed in the proper position at the bottom of the opening 22 to provide for the support for the stud wall 10.

Figure 2:
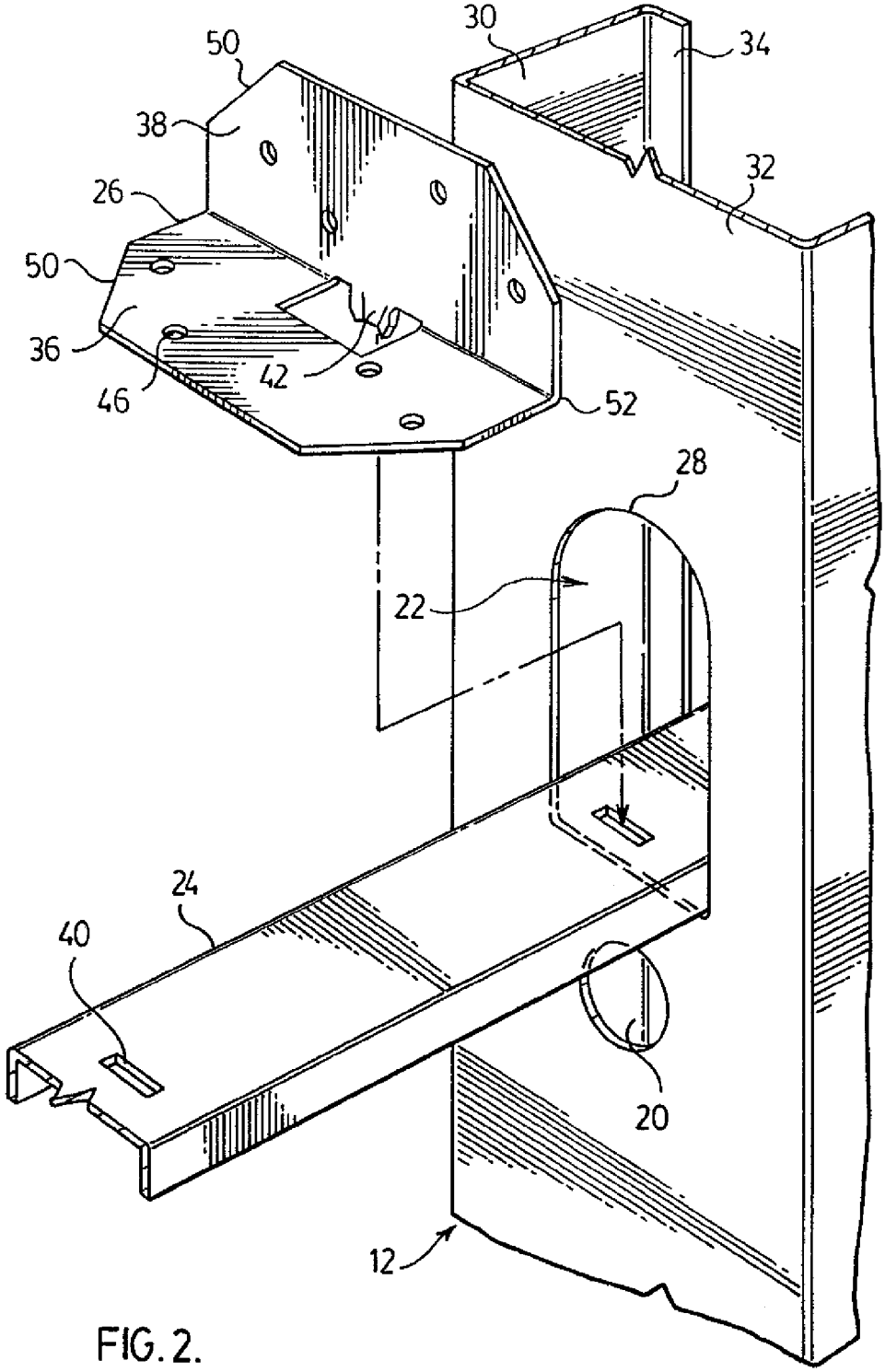
FIG. 2 is a perspective view of an embodiment of the bracket of the present invention.

FIG. 2 illustrates in closer detail the connection between the metal stud 12 and the bridging member 24 utilizing a preferred embodiment of a bracket 26 according to the present invention. Metal stud 12 is generally C shaped having flanges 30 connected along one edge by a web 32 and having inwardly projecting extensions 34 along the second edge. The opening 22 as described above is generally rectangular with a rounded over top portion 28. Bridging member 24 is generally U-shaped having a width approximately equal to the width of the opening 22. The bridging member 24 is installed in the openings 22 in the studs 12 by inserting the bridging member 24 vertically in the openings 22 and then rotating the bridging member 24 downwardly until it snaps into the proper position in the opening 22.

Once the bridging member 24 is installed within the opening 22, the brackets 26 for tying the bridging member 24 and metal stud 12 together may be installed. The bracket 26 provides for a secure connection between the metal stud 12 and bridging member 24. Bracket 26 transfers the support of the bridging member 24 across the web 32 of the stud 12 to provide for good support against, rotation and axial bending of the metal stud 12. A preferred embodiment of the bracket 26 of the present invention is illustrated in FIGS. 1 through 9. Bracket 26 is L-shaped having a leg 36 adapted in one orientation to rest against the bridging member 24 and an upright 38 adapted to rest against the web 32 of the stud 12. The L-shaped bracket transfers the support of the bridging member 24 to the metal stud 12. The length of the L-shaped bracket 24 should be sufficient to span the majority of the web of the metal stud 12.

In a first preferred embodiment illustrated in the figures, bridging member 24 is provided with slots 40 along the length thereof at regular spaced intervals. As the typical spacing of studs in a stud wall is 12, 16 or 24 inches on center, most preferably 16 inches on center, the spacing between slots 40 in the bridging member 24 is preferably 4 inches to accommodate the various spacing for the studs in the stud wall.

In the preferred embodiment illustrated in the figures, bracket 26 is provided with a downwardly extending member such as the tab 42 at the junction of the upright 38 and leg 36. The tab 42 is sized to fit within the opening 40 of the bridging member 24. The tab 42 is preferably formed by striking out the tab 42 from the metal forming the leg 36 and bending the tab 42 to lie in the place of the upright 38. In forming the opening 40, it may be preferred to provide an opening of a width greater than the thickness of the metal of the bridging member 24 as the die for striking out the opening 40 will be sturdier and have a longer life. In these situations, in order to provide a tight fit between the tab 42 and the opening 40, the tab is provided with edges which are bent inwardly to provide a depth to the tab 42 greater than the thickness of the metal.

Figure 3:
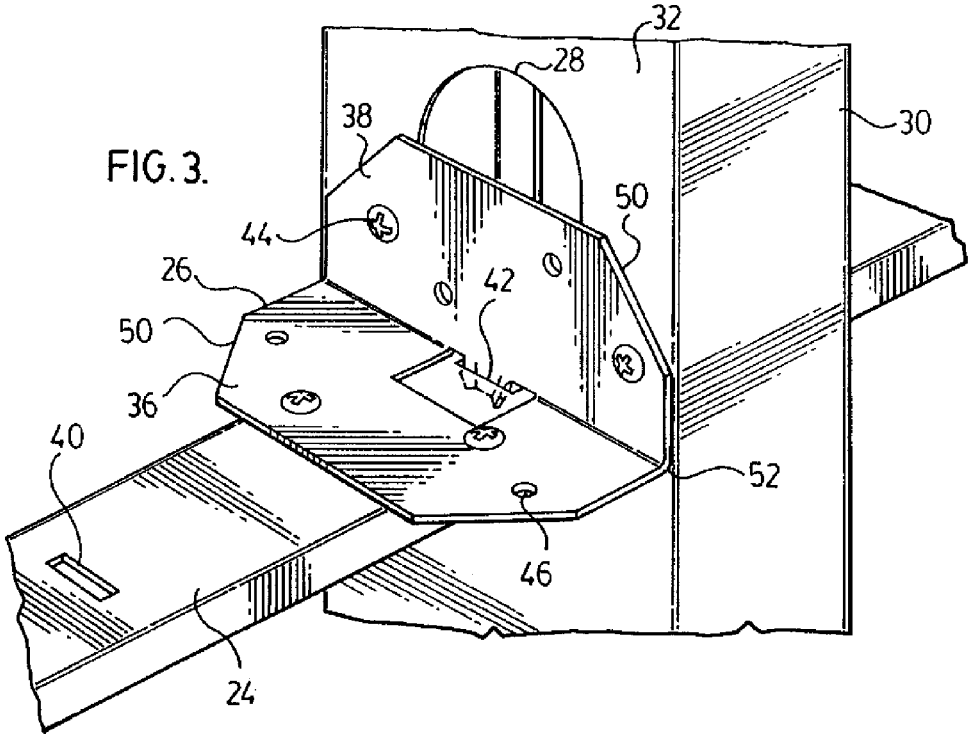
FIG. 3 is a perspective view of the bracket of FIG. 2 installed on the metal stud and bridging member in one orientation.

As illustrated in FIGS. 2 and 3, the bridging member 24 is attached to the stud 12 as described above. The bracket 26 is attached to the bridging member 24 and stud 12 as follows. The bracket 26 is placed over the bridging member 24 such that the downwardly extending tab 42 is inserted into the opening 40 of the bridging member 24. The stud 12 is then positioned such that the web 32 of the stud lies against the upright 38 of the bracket 26. In this manner the spacing of the studs 12 in the stud wall 10 is standard and uniform. The bracket 26 is then attached to the bridging member 24 and the web 32 of the stud 12 by suitable fasteners such as screws 44. In order to make the attachment easier, predrilled holes 46 are provided in the upright 38 and leg 36 of the bracket 26 as illustrated in the figures. Preferably four such holes 46 provided in each of the upright 38 and leg 36. Two holes 46 are provided near the outer edges of the bracket 26 that can be used to attach the bracket 26 to the web 32 of the stud 12. Two inner holes 46 are provided to allow the bracket 26 to be attached to the bridging member 24.

Figure 4:
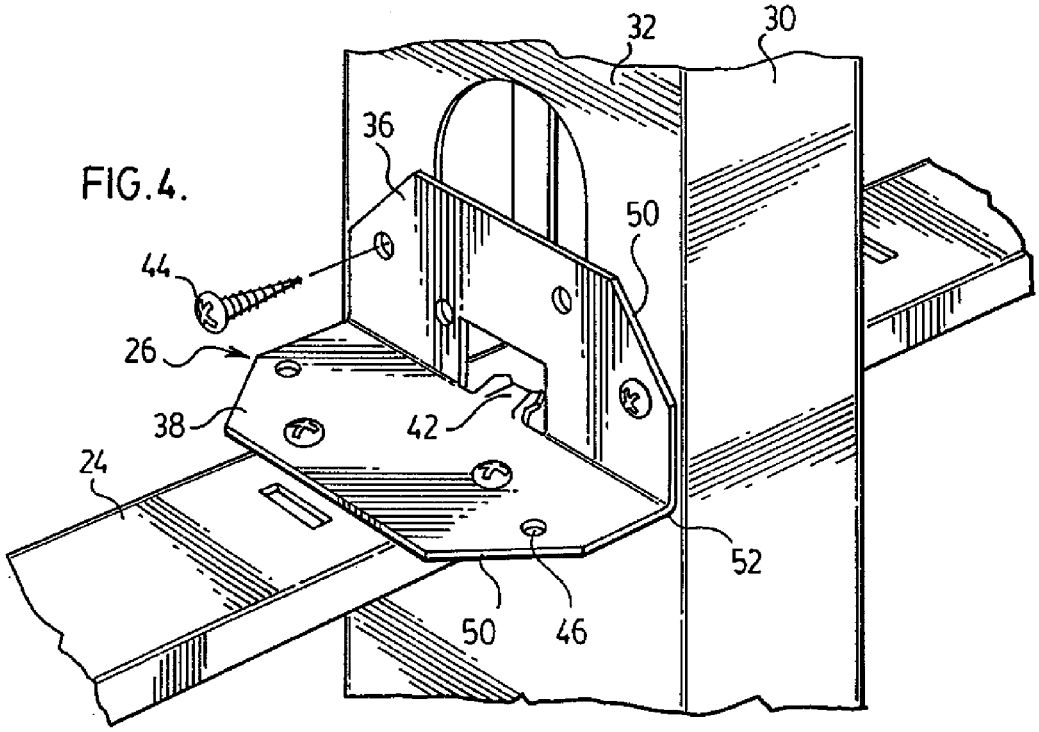
FIG. 4 is a perspective view of the bracket of FIG. 2 installed on the metal stud and bridging member in a second orientation where the studs may not be in the normal spacing of 12", 16" or 24" on center.
Figure 5:
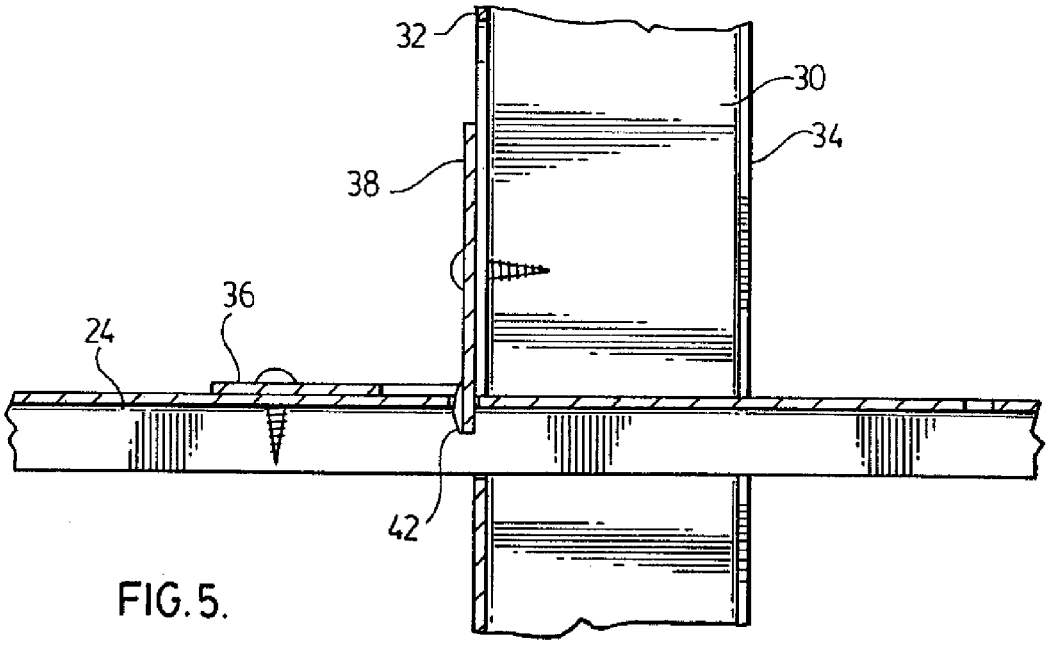
FIG. 5 is a cross section view of the bracket of FIG. 2 installed in the orientation according to FIG. 3.
Figure 6:
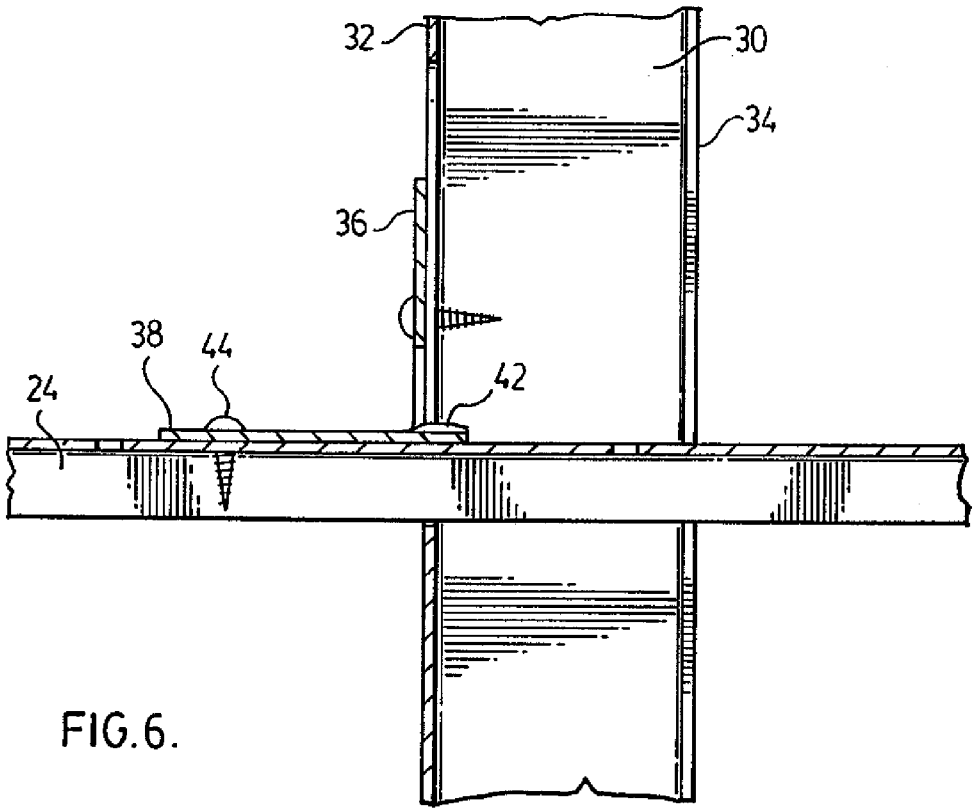
FIG. 6 is a cross section view of the bracket of FIG. 2 installed in the orientation in accordance with FIG. 4.

FIG. 4 illustrates an alternative arrangement for connecting the bridging member 26 to the stud 12 utilizing a bracket 26 of the present invention. This arrangement is used in situations where the bridging member 24 is not provided with the openings 40 or where, owing to the spacing of the studs 12 to frame a particular arrangement in the stud wall 10, the spacing of the stud 12 does not line up with the opening 40 of the bridging member 24. In this situation, the bracket 26 is reversed such that what was the upright 38 is placed against the bridging member 24 and what was the leg 36 is placed against the web 32 of the stud 12. The downwardly extending tab 42 lies along the upper surface of the bridging member 24 within the opening 22 and does not interfere with the connection of the bracket to the bridging member 24 or the stud 12.

There are situations where it may be required to install the bracket within the channel of the stud 12 rather than against the outer face of the web 32. With a preferred embodiment of the bracket 26 of the present invention this is easily accomplished as illustrated in FIGS. 7 to 9. Bracket 26 is preferably provided with truncated outer corners 50 of the upright 38 and leg 36. In the embodiment illustrated in the figures, these truncated corners 50 are accomplished by cutting the corners off at a 45° angle. However, other arrangements would be immediately apparent to those skilled in the art. The provision of the truncated corners 50 allows the bracket 26 to be inserted within the channel as illustrated in FIG. 7 and rotated into the proper position as illustrated in FIG. 8. This is accomplished as the distance between the corner 52 where the upright 38 and leg 36 join and the truncated corner 50 of the upright 38 or leg 36 on the opposite side is less than or equal to the inner width of the channel of the stud 12. Once the bracket 26 is in the proper position then it is easily attached to the bridging member 24 and stud 12 in the manner as described above. In prior art arrangements, the distance from the corner where the upright and the leg join and the outside corner on the opposite side of the bracket is significantly greater than the inner width of the stud and therefore the bracket cannot be rotated into position as the bracket of the present invention can. These prior art brackets were required to be installed by placing it at an open end of the stud and sliding them down the interior of the channel of the stud.

As illustrated in FIG. 9, the provision of the truncated corners allows a depth of the leg 36 and upright 38 of the bracket 26 to be greater than the distance between the web 32 and extensions 34 of the stud 12. This results in a larger load hearing surface in contact with the bridging member 24, thereby increasing the load transferring ability of the bracket 26. Prior art brackets installed in the channel of the stud had to have a leg depth less than the width of the channel in order to fit within the channel.

The present invention allows for much easier and quicker installation of metal stud partition walls in which studs are tied together by intermediate bridging members. In one aspect, the bridging members are provided with an opening at regularly spaced intervals, preferably 4" on center and the brackets which tie the bridging members and metal studs together are provided with tabs which insert into the openings of the bridging members and thereby properly locate the stud through the proper spacing. This allows the installer to quickly install the studs of the metal wall at the proper spacing and tie the studs together.

In addition, the use of the pre-punched openings of the bridging members to which the tabs of the brackets are inserted also aids in centering the brackets on the bridging member and the stud. This results in a stronger transfer of load bearing capability from the bridging member to the stud. In addition, as the bracket is centered on the stud, the bracket may be made wider, just slightly less than the width of the stud, which also results in better transfer of load bearing capability. As the bracket is also centered in the affixed position by means of the tab being inserted into the slot, there is no possibility of portions of the bracket extending past the edge of the stud and interfering with the installation of the finish surface material. With manually centered brackets of the prior art, if the installer was not careful, the bracket could be installed off center and interfere with the subsequent installation of the surface finish material.

In the second aspect of the invention, the bracket for tying a bridging member to a metal stud is provided with truncated outside corners such that the bracket may be easily installed within the channel of the stud by placing it vertically within the channel and rotating it into the proper position to overly the bridging member and the web of the stud. This also makes installation of the metal stud wall quicker and easier as it is not necessary for the installer to slide the bracket down the channel of the stud from one end or the other.

Although various preferred embodiments of the present invention have been described herein in detail, it will be appreciated by those of skill in the art that variations may be made thereto without departing from the spirit of the invention or the scope of the appended claims.

The embodiments of the invention in which an exclusive property or privilege is claimed are defined as follows:

1. A method for constructing a metal stud wall comprising:

providing a plurality of vertically parallel spaced apart metal studs held in position by a bottom track and top track, the metal studs having opposing flanges connected along a first edge by a central web to define a channel in the interior thereof and provided with inwardly faced extensions along a second edge;

each of the studs being provided with at least one opening, the at least one opening of the metal studs being generally horizontally aligned;

providing a bridging member to pass through and be contained within the aligned openings of the metal stud to provide lateral support for the metal stud wall;

providing an L shaped bracket having a leg for overlying the bridging member joined to an upright for overlying the metal stud, the width of the leg and upright being slightly less than the width of the channel of the metal stud, the depth of the leg and upright being both greater than the depth of the channel in the interior of the stud, the outside corners of the leg and upright of the L shaped bracket being truncated such that the diagonal dimension across the L-shaped bracket is less than the width of the channel of the metal stud;

placing the bridging member within the aligned openings of the metal stud;

placing the L-shaped bracket to overlie the bridging member and the metal stud, at least one of the brackets being installed in the channel of the metal stud by inserting the bracket vertically within the channel and rotating the bracket to the proper horizontal position, the truncated corners of the bracket allowing the bracket to be rotated within the channel to overlie the bridging member and the metal stud; and fastening the bracket to the metal studs and bridging member using suitable fastening means.

2. A method for constructing a stud wall according to claim 1 wherein each of the corners of the L-shaped bracket is truncated at a 45° angle with respect to a side and an outer edge of each of the upright and leg.

3. A metal stud wall comprising a top and bottom plate and a plurality of spaced apart metal studs bridging the top and bottom plate, each of the metal studs comprising a C-shaped member having an internal channel defined by a pair of opposed flanges, a central web joining the flanges along one edge and inwardly oriented projections along a second edge of the opposed flanges, the web being provided with at least one opening to receive a bridging member passing there through the bridging member passing through the aligned openings of a plurality of the metal studs and being attached to each of the metal studs by an L shaped bracket having a leg for overlying the bridging member joined to an upright for overlying the web of the metal stud, the width of the leg and upright being slightly less than the width of the internal channel of the metal stud, the depth of the leg and upright being both greater than the depth of the channel in the interior of the stud, the outside corners of the leg and upright of the L shaped bracket being truncated such that the diagonal dimension across the L-shaped bracket from a junction of the leg and upright to the opposite outside corner of the leg or upright is less than the width of the internal channel of the metal stud, so that at least one of the brackets may be inserted within the channel of the metal stud and rotated to the proper position for attaching to the bridging member and metal stud.

4. A metal stud wall according to claim 3 wherein each of the corners of the L-shaped bracket is truncated at a 45° angle with respect to aside and an outer edge of each of the upright and leg.

* * * * *